United States Patent [19]

Theurer et al.

[11] 4,342,165

[45] Aug. 3, 1982

[54] TRACK WORKING MACHINE WITH A BALLAST REMOVING AND PLANING DEVICE

[75] Inventors: Josef Theurer, Vienna; Manfred Brunninger, Linz, both of Austria

[73] Assignee: Franz Plasser Bahnbaumaschinen-Industriegesellschaft m.b.H., Vienna, Austria

[21] Appl. No.: 249,952

[22] Filed: Apr. 1, 1981

[30] Foreign Application Priority Data

Apr. 16, 1980 [AT] Austria ..... 2063/80

[51] Int. Cl.[3] ..... E02F 5/22

[52] U.S. Cl. ..... 37/104; 104/6

[58] Field of Search ..... 37/104–107; 171/16; 104/7 R, 6; 404/84

[56] References Cited

U.S. PATENT DOCUMENTS

| | | | |
|---|---|---|---|
| 2,609,619 | 9/1952 | Jones | 37/104 |
| 2,886,904 | 5/1959 | Kershaw | 37/104 |
| 2,899,759 | 8/1959 | Campbell | 37/104 |
| 3,054,459 | 9/1962 | Scheuchzer | 171/16 |
| 3,356,157 | 12/1967 | Plasser et al. | 171/16 |
| 3,436,848 | 4/1969 | Peppin et al. | 37/104 |
| 3,967,395 | 7/1976 | Stewart | 37/104 |
| 4,094,249 | 6/1978 | Theurer et al. | 104/6 |
| 4,108,076 | 8/1978 | Knape | 37/104 |
| 4,186,804 | 2/1980 | Theurer et al. | 37/104 X |

FOREIGN PATENT DOCUMENTS

| | | | |
|---|---|---|---|
| 195950 | 2/1958 | Austria | 37/104 |
| 197302 | 4/1958 | Austria | 37/104 |
| 210458 | 1/1960 | Austria | 37/104 |
| 267575 | 1/1969 | Austria | 37/104 |
| 1161575 | 1/1964 | Fed. Rep. of Germany | 37/104 |
| 2226612 | 1/1973 | Fed. Rep. of Germany | 37/104 |

*Primary Examiner*—E. H. Eickholt

*Attorney, Agent, or Firm*—Kurt Kelman

[57] ABSTRACT

In a track working machine for removing excess ballast from a ballast bed arranged to support a track defining a plane and for planing the ballast of the bed, which comprises a frame, undercarriages supporting the frame on the track for movement in a working direction, an improved ballast removing and planing device is mounted vertically adjustably on the frame and includes an endless ballast removing chain comprised of a multiplicity of chain members extending substantially parallel to the track plane, two chain reversing points about which the chain is trained for movement in a plane extending substantially vertically to the track plane, and a drive for moving the chain in the vertical plane and having an axis extending substantially parallel to the track plane, the chain having an upper and a lower stringer, the lower stringer facing away from the frame and projecting forwardly of the upper chain stringer in the working direction.

11 Claims, 6 Drawing Figures

TRACK WORKING MACHINE WITH A BALLAST REMOVING AND PLANING DEVICE

The present invention relates to a track working machine for removing excess ballast from a ballast bed arranged to support a track defining a plane, especially such ballast piles as remain in the crib spaces after track ties have been removed from the bed during a track renewal operation, and for planing the ballast of the bed before new ties are laid. Such machines comprise a frame, undercarriages supporting the frame on the track for movement of the machine in a working direction, and a ballast removing a planing device mounted vertically adjustably on the frame between the undercarriages, and this invention is directed more particularly to an improved device of this type.

A track laying apparatus incorporating a machine of this type is disclosed in U.S. Pat. No. 4,094,249, dated June 13, 1978. This machine comprises a frame bridging a trackless portion of a right of way during a track renewal operation and supported on the ballast of this trackless portion by a track-laying bogie. An endless scraper conveyor chain is vertically adjustably mounted on the frame and moves about the track-laying bogies in an inclined plane. The chain path is pentagonal and a drive is arranged at the highest reversing point of the endless chain for moving the chain. A trough-shaped enclosure surrounds the scraper elements of the chain at least in the lower portion of the chain so that, upon engagement of the chain with the ballast and movement of the chain in the inclined plane, the scraper elements continuously remove excess ballast and transport the removed ballast in the trough-shaped enclosure to the highest reversing point of the chain. Conveyor means receive the removed ballast at this point and further convey the excess ballast to chutes which return the ballast to the cribs between the newly laid track ties.

Austrian Pat. No. 210,458, published Aug. 10, 1960, discloses an apparatus for compacting the sub-grade of a region of the ballast bed from which the ballast has been removed for cleaning. This sub-grade compacting apparatus is mounted on a mobile ballast cleaning machine rearwardly of suitable ballast excavating means in the operating direction of the machine and is comprised of a pair of compactors pivotal in a plane underneath the track about vertical pivots in each ballast bed shoulder. The ballast excavating means comprises two ballast removing and planing chains also pivotally mounted on the machine frame in the shoulders and the planes of movement of the chains are substantially parallel to the track plane. A bucket conveyor is arranged at each end of the ballast removing and planing chains in the track shoulder and conveys the removed ballast to a screen arrangement. Thus, to assure the highest possible efficiency in removing all of the ballast from the bed resting on the sub-grade, the stringers of the chains run parallel to the track plane.

German Patent Application No. 2,226,612, published Jan. 4, 1973, discloses a mobile ballast cleaning machine whose ballast removing devices are so arranged on the machine frame that the plane of movement of the ballast removing chains may be slightly adjusted longitudinally as well as laterally from their normally parallel extension in relation to the track plane. The extent of the adjustment depends on the degree of encrustation of the ballast and its size, and it is designed to reduce the high torque to which the ballast removing chains, which are pivotally supported at only one end, are subjected. To reduce these forces, the height of the excavating chain has been considerably reduced in this machine and this excavating device, too, serves primarily for the removal of all the ballast down to the sub-grade, the ballast in a ballast bed being frequently heavily encrusted and offering a high resistance to the excavating chain. To deal with these conditions, the chain stringers run parallel to the track plane so that the ballast removing elements of the chain can fully engage the ballast and remove it with scrapers which extend into the ballast substantially vertically to the track plane.

It is a primary object to the invention to provide an improved ballast removing and planing device in a track working machine of the first-indicated type, which enables piles of ballast to be removed rapidly and efficiently from a track tie supporting ballast bed while leaving a substantially smooth bed capable of supporting newly laid track ties, the device being simple, relatively light but, nevertheless, sturdy.

The above and other objects are accomplished according to the present invention with a ballast removing and planing device which includes an endless ballast removing chain comprised of a multiplicity of chains membzrs extending substantially parallel to the track plane, two chain reversing points about which the chain is trained for movement in a plane extending substantially vertically to the track plane, and a drive for moving the chain in the substantially vertically extending plane and having an axis extending substantially parallel to the track plane, the chain having an upper and a lower stringer, the lower chain stringer facing away from the machine frame and projecting forwardly of the upper chain stringer in the working direction of the machine.

With an endless ballast removing chain whose chain members and drive axis extend substantially parallel to the track plane during operation and which moves in a substantially vertically extending plane, it is possible in an unexpectedly simple manner efficiently to remove piles of ballast remaining in the crib spaces after track ties have been removed from the bed during a track renewal operation, for example, the remaining portion of the ballast in the bed being simultaneously subjected to planing and a partial compaction. If the chain members are slightly inclined in relation to the ballast bed in the working direction of the machine, an enhanced resistance to displacement of the ballast while it is entrained by the chain members is obtained. Because the ballast removing chain exerts a substantially vertical, somewhat olique force downwardly towards the sub-grade, the lateral displacement of the ballast remaining in the bed, which is caused by the irregular separation plane, causes this ballast to be re-oriented and compacted at the surface of the bed. The vertical force component of the oblique downward force makes an unhindered, immediately effective depth adjustment possible. The provision of only two reversing points over which the chain is trained enables the height of the endless chain structure to be minimized.

The above and other objects, advantages and features of this invention will become more apparent from the following detailed description of now preferred embodiment thereof, taken in conjunction with the accompanying schematic drawing wherein.

Figure 1:
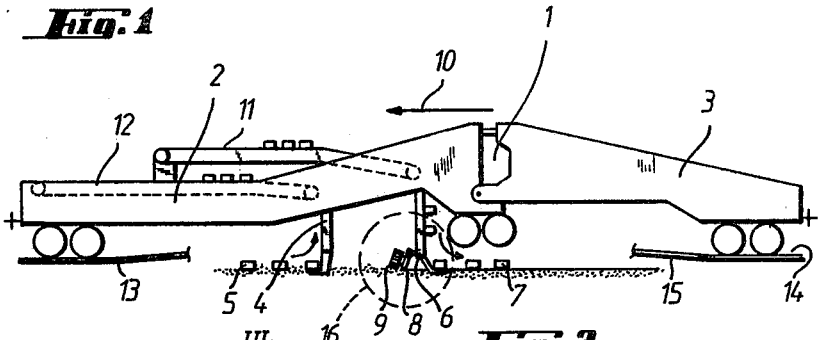
FIG. 1 is a side elevational view of a track working machine with the improved ballast removing and planing device of the invention.

Referring now to the drawing and first to FIG. 1, illustrated track working machine 1 may constitute a part of an otherwise conventional track renewal train, such as disclosed in U.S. Pat. Nos. 4,046,077 or 4,094,249, and this machine may be self-propelled. The illustrated frame of machine 1 is constituted by two frame parts 2 and 3 which are pivotally connected to enable the elongated frame to operate in track curves. Undercarriages support frame 2, 3 on rails 13 of the partially shown old track and on rails 15 of the partially shown newly laid track, respectively, leaving therebetween a trackless bed of ballast 27 where the track replacement takes place and the machine moving in a working direction indicated by arrow 10. Schematically illustrated mechanism 4 for picking up old ties 5 is mounted on front frame part 2 and moves the picked-up ties to conveyor 12 while similarly schematically illustrated mechanism 6 receives new ties 7 from conveyor 11 for laying the new ties on the planed ballast bed provided by ballast removing and planing device 9 arranged on the machine frame forwardly of mechanism 6 which is mounted on rear frame part 3. Newly laid rails 15 define plane 14 of the new track laid by the machine while it moves in the direction of arrow 10. Ballast removing and planing device 9 is vertically adjustable mounted on frame 2, 3 by means of hydraulic jack 23 shown in the detailed view of FIG. 2.

As illustrated in this figure, improved device 9 includes endless ballast removing chain 20 comprised of a multiplicity of chain members 17 extending substantially parallel to track plane 14 and having upper stringer 19 and lower stringer 18 facing away from the frame and projecting forwardly of the upper chain stringer in the working direction. The chain is trained over two chain reversing points for movement in plane 33 extending substantially vertically to track plane 14 and drive 21, which is illustrated as a hydraulic motor having axle 31 (see FIG. 3) extending in the axis of the drive, moves the chain in plane 33, the drive axis extending substantially parallel to track plane 14.

In the preferred illustrated embodiment, ballast plow 8 is arranged rearwardly of the ballast removing chain in the working direction, the illustrated ballast plow being rigidly connected with ballast removing chain 20 and being vertically adjustable therewith by means of parallelogram suspension 22 linking the ballast plow to tie laying mechanism 6 so that the ballast removing chain is supported on the machine frame for vertical pivoting about axes extending parallel to track plane 14. Hydraulic pressure fluid lines 24 are connected to the cylinder chambers of hydraulic jack 23 and hydraulic motor 21 to enable the improved device 9 to be vertically adjusted on the machine frame and endless ballast removing chain 20 to be moved for ballast removal in the vertically adjusted position of the device.

The combination of the ballast removing chain with the ballast plow makes the ballast transport particularly efficient, the ballast piled up by the plow as the machine advances in the working direction being constantly removed by the moving chain so that only as much ballast remains as is required for plaining the ballast bed. Thus, plow 8 serves merely for smoothing the bed which has previously been freed of excess ballast and planed by moving chain 20. Therefore, the ballast plow may be preferably of very simple construction, being constituted by a transverse beam-like element. Since no ballast accumulates in front of the plow, the machine requires less traction force as it is driven in the working direction.

The rigid interconnection of the ballast removing chain and the ballast plow, and their common vertical adjustability, have the advantage of always keeping the distance between the lower stringer of the chain and the lower edge of the plow constant to obtain a constant and accurate ballast bed for laying the new ties. It also simplifies the support of the chain and plow on the machine frame. The use of the parallelogram suspension for this purpose assures the desired inclination of the ballast removing chain in relation to the track plane independently of the vertical adjustment by jack 23.

Figure 2:
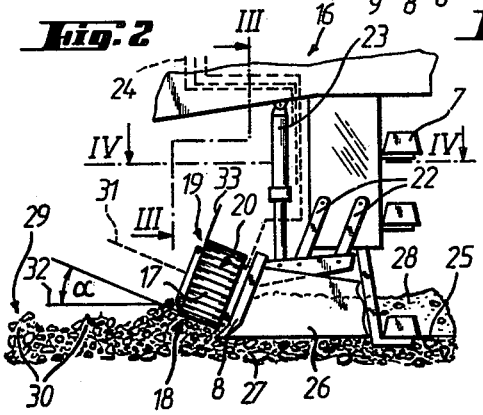
FIG. 2 is an enlarged, detailed view of the improvement device shown encircled by broken line 16 in FIG. 1.
Figure 3:
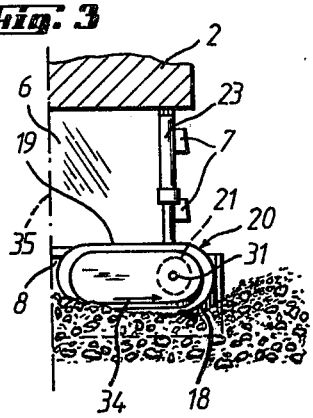
FIGS. 3 and 4 are, respectively, side and top views of the device along lines III—III and IV—IV of FIG. 2.
Figure 4:
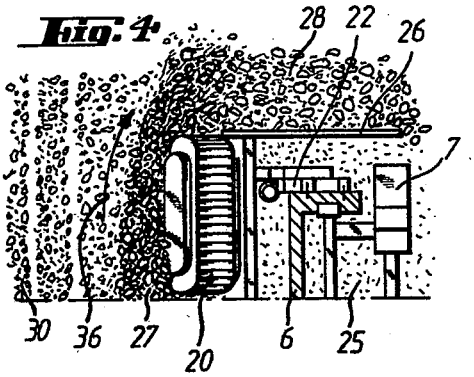

As shown in FIGS. 2 to 4, in its lowered operating position, the lower edge of ballast plow 8 will produce smooth plane 25 for support of newly laid ties 7 on the planed ballast bed, the ballast plane 25 being parallel to track plane 14. Protective shield 26 is affixed to each end of transversely extending ballast plow 8 and the lower edge of the shields glides along ballast plane 25, thus preventing ballast 28 piled on the shoulders of the track from entering the planed ballast bed between the protective shields, the piles of ballast 28 being formed as chain 20 removes ballast 27 laterally in the direction of arrow 36. FIGS. 2 and 4 show piles 30 of ballast remaining on ballast bed 29 in front of device 9 after old ties 5 have been removed.

In the preferred embodiment illustrated herein, drive axle 31 of endless chain 20 and chain members 17 enclose with track plane 14 (and parallel tie-supporting ballast bed plane 25) an angle of about 5° to 25°. For the sake of clarity, this angle is shown in FIG. 2 in relation to plane 32 which is parallel to planes 14 and 25. This inclination is sufficient to cause lower chain stringer 18 to project forwardly of upper chain stringer 19 in the working direction of the machine. Plane 33 is defined by a point of chain member 17 during one full revolution of endless chain 20 as it is driven by motor 21 and is perpendicular to motor axle 31.

Within such a range of the angle of inclination, a favorable relation is obtained between the force component effective in the track plane and the force component perpendicular thereto exerted by the ballast removing chain on the ballast being removed. This produces a more efficient and trouble-free entrainment of the ballast and an effective planing of the ballast bed, the resultant wedge of ballast (see in FIG. 2) also filling any locally occurring recesses in the bed.

For the sake of simplification, FIG. 3 shows only one half of the ballast removing and planing device on one side of plane of symmetry 35, the other half of the device on the other side of the plane of symmetry being identical. Arrow 34 indicates the direction of movement of endless chain 20.

FIG. 4 is a top view of the half of the device shown in FIG. 3 and arrow 36 indicates the direction in which ballast 27 is laterally displaced.

Figure 5:
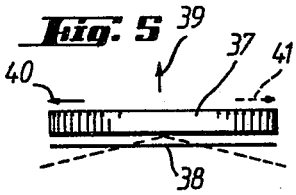
FIGS. 5 and 6 are highly schematic top views of the two other embodiments of the improved ballast removing and planing device.

In the embodiment illustrated diagrammatically in FIG. 5, the ballast removing and planing device has and endless chain 37 extending over the entire width of the ballast bed and moving in a plane extending vertically to the track plane, i.e. without substantial inclination in relation thereto. The chain may be moved either in the direction of arrow 40 or of arrow 41 while the machine advances in a working direction indicated by arrow 39.

In this embodiment, the ballast removing chain is associated with a ballast plow 38 which is V-shaped. This type of ballast plow is known and enables considerable accumulations of ballast to be laterally displaced without problems since the ballast will flow along the two wings of the plow towards the track shoulders as the machine advances.

Figure 6:
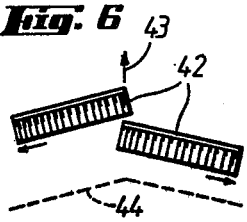

In the embodiment of FIG. 6, V-shaped plow 44 is associated with a pair of endless ballast removing chains 42 and 43 each extending over a respective half of the ballast bed and the two ballast removing chains overlapping in a center region of the ballast bed. Each chain has its own drive. This provides a very simple and effective structure for moving the ballast to both track shoulders, producing higher efficiency than a single chain extending over the entire bed because of the shorter transportation path for the removed ballast. The overlapping V-shaped arrangement of the ballast removing chains enables the chains to engage the ballast over a longer period and thus increases the planing effect, all of the ballast being removed since the chains overlap in the center region of the bed.

All of the illustrated embodiments of the invention operate in the following manner:

Track working machine 1 is incorporated into a track renewal train and is moved by its own drive to the track section to be renewed, i.e. where an old track is to be removed and replaced by a new track, the old track being continuously removed as the machine advances in the direction of arrow 10 and the new track being continuously laid. After old rails 13 are detached from old ties 5 and removed, the old ties are picked by mechanism 4, leaving piles 30 of ballast on ballast bed 29 in the spaces which formed the cribs of the old track. Ballast removing and planing device 9 and associated ballast plow 8 are vertically adjusted by hydraulic jack 23 so that they engage ballast 27. Independent of the extent of the lowering of device 9, parallelogram suspension 22 assures a constant angle between chain members 17 and ballast bed plane 25 (or track plane 14 which is parallel thereto). While this angle may be zero, an acute angle will be preferred and may be selected in dependence of the desired transport efficiency, planing effect or desired compacting effect. The extent of the vertical adjustment determines the level of ballast plane 25 supporting the ties of the new track.

Piles 30 of ballast accumulated above ballast plane 25 is removed by the movement of the endless ballast removing chain to the shoulder of ballast bed 29 where the removed ballast accumulates in piles 28. When chain members 17 are slightly inclined in relation to plane 25 by an angle, as shown in FIG. 2, ballast 27 cannot escape rearwardly when it is entrained by the endless chain so that the ballast removing operation will proceed very efficiently and effectively. Since the resultant oblique force on ballast 27, which is perpendicular to endless chain 20, is composed of a horizontal and a vertical component, the vertically effective component will also exert a compaction force on the remaining ballast. The immediately following ballast plow has a lower edge slightly lower than the lower edges of chain members 17 engaging the ballast so that the lower plow edge will smooth the planed ballast bed to form an accurate support plane 25 for new ties 7, which is parallel to plane 14 of the new track. Protective shields 26 prevent an undesired return of shoulder ballast piles 28 to the smoothed ballast bed at least up to the region of the first-laid new tie 7. The new ties are laid on the smooth ballast plane by mechanism 6, whereon new rails 15 are placed on the newly laid ties and fastened thereto to define track plane 14 with their upper running faces.

While the use of the track working machine in track renewal trains is particularly advantageous and has been specifically described hereinabove, such a machine may also be used for other purposes, for instance on ballast cleaning machines equipped with a ballast excavating chain wherein the improved device of the present invention may be utilized to plane the excavated and cleaned ballast returned to the sub-grade and to remove excess ballast to the shoulder of the ballast bed. The planed ballast is then used as support for the track which has been raised off the bed during the ballast cleaning and planing operation and is then lowered back onto the cleaned and planed ballast. It is also possible to use this device for planing the soil of the subgrade before the cleaned ballast is placed thereon or simply to remove all the ballast.

Throughout the specification and claims, the term "substantially vertically to the track plane" includes an angle from about 65° to 90° and the term "substantially parallel to the track plane" includes an angle of inclination of 0° to 25°. The chain members of the endless ballast removing chain are designed to entrain and push the ballast to a respective shoulder of the track as the lower chain string engages the ballast with chain members extending perpendicularly to the plane of chain movement.

What is claimed is:

1. In a track working machine for removing excess ballast from a ballast bed arranged to support a track defining a plane and for planing the ballast of the bed, which comprises a frame, undercarriages supporting the frame on the track for movement of the machine in a working direction, and a ballast removing and planing device mounted vertically adjustably on the frame between the undercarriages: the improvement of the device including (a) an endless ballast removing chain comprised of a multiplicity of chain members extending substantially parallel to the track plane, (b) two chain reversing points about which the chain is trained for movement in a plane extending substantially vertically to the track plane, and (c) a drive for moving the chain in the substantially vertically extending plane and having an axis extending substantially parallel to the track plane, (1) the chain having an upper and a lower stringer, the lower chain stringer facing away from the frame and projecting forwardly of the upper chain stringer in the working direction.

2. In the track working machine of claim 1, a ballast plow arranged rearwardly of the ballast removing chain in the working direction.

3. In the track working machine of claim 2, the ballast plow being rigidly connected with frame means mounting the ballast removing chain and being vertically adjustable therewith.

4. In the track working machine of claim 2 or 3, wherein the ballast plow is V-shaped.

5. In the track working machine of claim 1 or 2, the chain members enclosing an angle of about 5° to 25° with the track plane.

6. The track working machine of claim 5, the axis of the drive enclosing an angle of about 5° to 25° with the track plane.

7. In the track working machine of claim 6, the drive being a hydraulic motor having an axle extending in said axis.

8. In the track working machine of claim 1, 2 or 3, a parallelogram suspension supporting the ballast removing chain on the frame for vertical pivoting about axes extending parallel to the track plane.

9. In the track working machine of claim 1 or 2, a pair of said devices, the endless ballast removing chain of each device extending over a respective half of the ballast bed.

10. In the track working machine of claim 9, wherein the ballast removing chains overlap in a center region of the ballast bed.

11. In the track working machine of claim 9 or 10, wherein the ballast removing chains are inclined with respect to each other to form a V.

* * * * *